US011298284B2

(12) United States Patent
Bayerlein et al.

(10) Patent No.: US 11,298,284 B2
(45) Date of Patent: Apr. 12, 2022

(54) MOTORIZED RECUMBENT THERAPEUTIC AND EXERCISE DEVICE

(71) Applicant: Woodway USA, Inc., Waukesha, WI (US)

(72) Inventors: Douglas G. Bayerlein, Oconomowoc, WI (US); Nicholas A. Oblamski, Waukesha, WI (US); Vance E. Emons, Hartland, WI (US); Kasey Mylin, Milton, WI (US)

(73) Assignee: Woodway USA, Inc., Waukesha, WI (US)

( * ) Notice: Subject to any disclaimer, the term of this patent is extended or adjusted under 35 U.S.C. 154(b) by 628 days.

(21) Appl. No.: 15/892,484

(22) Filed: Feb. 9, 2018

(65) Prior Publication Data

US 2018/0228682 A1 Aug. 16, 2018

Related U.S. Application Data

(60) Provisional application No. 62/457,417, filed on Feb. 10, 2017.

(51) Int. Cl.
*A61H 1/02* (2006.01)
*A63B 22/00* (2006.01)
(Continued)

(52) U.S. Cl.
CPC ..... *A61H 1/0214* (2013.01); *A61H 1/0237* (2013.01); *A61H 1/0255* (2013.01);
(Continued)

(58) Field of Classification Search
CPC .. A61H 1/0214; A61H 1/0255; A61H 1/0274; A61H 1/0237; A61H 2203/0437;
(Continued)

(56) References Cited

U.S. PATENT DOCUMENTS 583,920 A 6/1897 Montgomery
1,820,372 A 8/1931 Blomquist
(Continued)

FOREIGN PATENT DOCUMENTS

EP 2 364 686 A1 9/2011
EP 2364686 B1 * 3/2015 ..... A61H 1/02
(Continued)

OTHER PUBLICATIONS

English translation for EP 2364686 B1—Mar. 11, 2015 (Year: 2015).*
(Continued)

*Primary Examiner* — Quang D Thanh
(74) *Attorney, Agent, or Firm* — Foley & Lardner LLP

(57) ABSTRACT

A device for therapy or exercise includes a frame, a base at least partially supporting and extending from the frame, a user support moveably coupled to the base and positioned adjacent the frame, a foot crank system coupled to the frame, a hand crank system coupled to the frame, and a motor coupled to at least one of the foot crank system and the hand crank system. The motor selectively powers the foot crank system and the hand crank system and is operable in an active mode and a passive mode.

21 Claims, 9 Drawing Sheets

(51) Int. Cl.

| | |
|---|---|
| ***A63B 22/06*** | (2006.01) |
| ***A63B 21/00*** | (2006.01) |
| ***A63B 21/005*** | (2006.01) |
| ***A63B 24/00*** | (2006.01) |

(52) U.S. Cl.

CPC ..... *A61H 1/0274* (2013.01); *A63B 21/0051* (2013.01); *A63B 21/0058* (2013.01); *A63B 21/00178* (2013.01); *A63B 21/00181* (2013.01); *A63B 21/00185* (2013.01); *A63B 22/001* (2013.01); *A63B 22/0002* (2013.01); *A63B 22/0087* (2013.01); *A63B 22/0605* (2013.01); *A63B 24/0087* (2013.01); *A61H 2201/0192* (2013.01); *A61H 2201/12* (2013.01); *A61H 2201/1261* (2013.01); *A61H 2201/1269* (2013.01); *A61H 2201/164* (2013.01); *A61H 2201/1635* (2013.01); *A61H 2201/1671* (2013.01); *A61H 2201/501* (2013.01); *A61H 2201/5035* (2013.01); *A61H 2201/5046* (2013.01); *A61H 2201/5097* (2013.01); *A61H 2203/02* (2013.01); *A61H 2203/0437* (2013.01); *A61H 2230/06* (2013.01); *A63B 21/4015* (2015.10); *A63B 21/4019* (2015.10); *A63B 2022/0623* (2013.01); *A63B 2208/0238* (2013.01); *A63B 2220/00* (2013.01); *A63B 2220/20* (2013.01); *A63B 2220/30* (2013.01); *A63B 2220/62* (2013.01); *A63B 2225/09* (2013.01); *A63B 2225/20* (2013.01); *A63B 2225/50* (2013.01); *A63B 2230/75* (2013.01)

(58) Field of Classification Search

CPC .... A61H 2201/5097; A61H 2201/0192; A61H 2203/02; A61H 2201/1269; A61H 2201/501; A61H 2201/1261; A61H 2201/5046; A61H 2201/12; A61H 2201/1671; A61H 2201/1635; A61H 2201/164; A61H 2230/06; A61H 2201/5035; A61H 1/00; A63B 21/00181; A63B 21/0058; A63B 21/00178; A63B 21/00185; A63B 22/001; A63B 21/0051; A63B 24/0087; A63B 22/0087; A63B 22/0002; A63B 22/0605; A63B 2220/00; A63B 2225/50; A63B 2208/0238; A63B 2225/20; A63B 2225/09; A63B 21/4019; A63B 2022/0623; A63B 21/4015; A63B 2220/30; A63B 2220/62; A63B 2220/20; A63B 2230/75; A63B 71/0622; A63B 2220/833; A63B 2208/0228; A63B 2230/06; A63B 2225/093; A63B 2071/025; A63B 2220/80

See application file for complete search history.

(56) References Cited

U.S. PATENT DOCUMENTS

| | | | | |
|---|---|---|---|---|
| D191,792 | S | 11/1961 | Maratta | |
| 3,017,180 | A | 1/1962 | Allan | |
| 3,213,852 | A | 10/1965 | Zent | |
| 3,216,722 | A | 11/1965 | Odam | |
| 3,455,295 | A | 7/1969 | Kellogg | |
| 3,572,699 | A | 3/1971 | Nies | |
| 3,824,993 | A | 7/1974 | Grant | |
| 3,964,742 | A | 6/1976 | Carnielli | |
| 3,991,749 | A | 11/1976 | Zent | |
| 4,402,502 | A | 9/1983 | Peters | |
| 4,436,097 | A | 3/1984 | Cunningham | |
| 4,572,501 | A | 2/1986 | Durham et al. | |
| 4,577,862 | A * | 3/1986 | Sagedahl | A63B 21/0058 482/7 |
| 4,589,656 | A | 5/1986 | Baldwin | |
| 4,592,545 | A * | 6/1986 | Sagedahl | A63B 21/0058 482/7 |
| 4,612,447 | A | 9/1986 | Rowe | |
| 4,618,141 | A | 10/1986 | Ashworth, Jr. | |
| 4,688,791 | A | 8/1987 | Long | |
| 4,712,789 | A | 12/1987 | Brilando | |
| 4,842,269 | A | 6/1989 | Huang | |
| 4,846,156 | A | 7/1989 | Kopnicky | |
| 4,934,692 | A | 6/1990 | Owens | |
| 4,947,836 | A | 8/1990 | Laenger et al. | |
| 4,976,426 | A | 12/1990 | Szabo et al. | |
| 5,044,627 | A | 9/1991 | Huang | |
| 5,145,479 | A | 9/1992 | Olschansky et al. | |
| 5,242,179 | A | 9/1993 | Beddome et al. | |
| 5,242,339 | A | 9/1993 | Thornton | |
| 5,318,487 | A | 6/1994 | Golen et al. | |
| 5,330,402 | A | 7/1994 | Johnson | |
| 5,336,147 | A | 8/1994 | Sweeney, III | |
| 5,342,262 | A | 8/1994 | Hansen | |
| 5,343,856 | A * | 9/1994 | Proctor | A61H 1/0214 482/60 |
| 5,449,334 | A | 9/1995 | Kingsbury | |
| 5,569,128 | A | 10/1996 | Dalebout | |
| 5,595,557 | A | 1/1997 | Lambert et al. | |
| 5,601,515 | A | 2/1997 | Matsumoto | |
| 5,857,943 | A | 1/1999 | Murray | |
| 5,906,563 | A | 5/1999 | Pittari | |
| 5,980,431 | A | 11/1999 | Miller, Jr. | |
| 6,036,623 | A | 3/2000 | Mitchell | |
| 6,135,923 | A | 10/2000 | Stearns et al. | |
| 6,328,676 | B1 | 12/2001 | Alessandri | |
| 6,454,679 | B1 | 9/2002 | Radow | |
| 6,840,892 | B1 | 1/2005 | Wu | |
| 6,902,515 | B2 | 6/2005 | Howell et al. | |
| 6,960,155 | B2 | 11/2005 | Chien et al. | |
| 7,510,512 | B1 | 3/2009 | Taggett | |
| 7,625,318 | B1 | 12/2009 | Heyn | |
| 7,789,808 | B2 | 9/2010 | Lee | |
| 7,862,483 | B2 | 1/2011 | Hendrickson et al. | |
| 8,075,450 | B2 | 12/2011 | Fabbri et al. | |
| 8,113,996 | B1 | 2/2012 | Allen | |
| 8,118,715 | B2 | 2/2012 | Greene et al. | |
| 8,206,269 | B2 | 6/2012 | Fabbri et al. | |
| 8,328,214 | B2 | 12/2012 | Yang | |
| 8,409,060 | B2 | 4/2013 | Hsu | |
| 8,676,170 | B2 | 3/2014 | Porrati et al. | |
| 9,305,141 | B2 | 4/2016 | Fabrizio | |
| D788,792 | S | 6/2017 | Alessandri et al. | |
| 9,824,110 | B2 | 11/2017 | Giudici et al. | |
| D826,349 | S | 8/2018 | Oblamski et al. | |
| 10,238,911 | B2 | 3/2019 | Bayerlein et al. | |
| 10,426,996 | B1 | 10/2019 | Brumit | |
| 2002/0049122 | A1 * | 4/2002 | Mercado | A63B 21/00181 482/57 |
| 2002/0061804 | A1 | 5/2002 | Hasegawa | |
| 2003/0092533 | A1 | 5/2003 | Hippensteel | |
| 2004/0097341 | A1 | 5/2004 | Alessandri et al. | |
| 2004/0259693 | A1 | 12/2004 | Chien et al. | |
| 2005/0143226 | A1 | 6/2005 | Heidecke | |
| 2006/0003871 | A1 | 1/2006 | Houghton et al. | |
| 2006/0252607 | A1 | 11/2006 | Holloway | |
| 2008/0085819 | A1 | 4/2008 | Yang | |
| 2008/0254949 | A1 | 10/2008 | Fernandes | |
| 2010/0222182 | A1 | 9/2010 | Park | |
| 2010/0234179 | A1 | 9/2010 | Cronje | |
| 2011/0237400 | A1 * | 9/2011 | King | A63B 21/0056 482/8 |
| 2012/0264569 | A1 | 10/2012 | Escobedo et al. | |
| 2013/0260965 | A1 | 10/2013 | Chia et al. | |
| 2014/0243160 | A1 | 8/2014 | Lim | |
| 2015/0157895 | A1 | 6/2015 | Bettini | |
| 2015/0273267 | A1 | 10/2015 | Manzke et al. | |
| 2015/0328496 | A1 | 11/2015 | Eder | |
| 2018/0001134 | A1 | 1/2018 | Bayerlein et al. | |
| 2018/0111023 | A1 | 4/2018 | Cei et al. | |
| 2018/0154204 | A1 | 6/2018 | Bayerlein et al. | |

(56) References Cited

U.S. PATENT DOCUMENTS

| | | | |
|---|---|---|---|
| 2018/0229065 | A1 | 8/2018 | Leonardi et al. |
| 2019/0217153 | A1 | 7/2019 | Bayerlein et al. |
| 2020/0086166 | A1 | 3/2020 | Bayerlein et al. |

FOREIGN PATENT DOCUMENTS

| | | | |
|---|---|---|---|
| GB | 2 096 006 | | 10/1982 |
| WO | WO-2009/014330 | A1 | 1/2009 |
| WO | WO-2016/093596 | A1 | 6/2016 |
| WO | WO-2016/191561 | | 12/2016 |
| WO | WO-2018/006055 | | 1/2018 |

OTHER PUBLICATIONS

International Search Report and Written Opinion regarding Application No. PCT/US2016/034344, dated Aug. 31, 2016, 16 pps.

Liszewski, Andrew, "EcoMill Treadmill Generates Its Own Power", Jun. 1, 2009, http://www.ohgizmo.com/2009/06/04/ecomill-treadmill-generates-its-own-power/, 1 page.

NASA, "International Space Station: Combined Operational Load Bearing External Resistance Treadmill (COLBERT)", Jul. 19, 2017, https://www.nasa.gov/mission_pages/station/research/experiments/765.html, 4 pages.

NASA, "International Space Station: Do Tread on Me", Aug. 19, 2009, https://www.nasa.gov/mission_pages/station/behindscenes/colbert_feature.html, 2 pages.

NASA, "International Space Station: Treadmill with Vibration Isolation and Stabilization System (TVIS)", May 17, 2018, https://www.nasa.gov/mission_pages/station/research/experiments/976.html, 5 pages.

NASA, "Space Shuttle Mission STS-128: Racking Up New Science", Press Kit, Aug. 2009, 116 pages.

Owners Manual, Force 1, Nov. 29, 2007, 44 pages.

Southern Research et al., "AIMTech Project Brief", Oct. 20, 2015, 2 pages.

Woodway, "Introducing the All New EcoMill Self Powered", published to YouTube on Mar. 25, 2010, https://www.youtube.com/watch?v=NcPH92DAArc.

Extended European Search Report for European Application No. 18156027.7, dated Nov. 6, 2018, 9 pages.

* cited by examiner

MOTORIZED RECUMBENT THERAPEUTIC AND EXERCISE DEVICE

CROSS REFERENCE TO RELATED PATENT APPLICATION

This application claims the benefit of and priority to U.S. Provisional Patent Application No. 62/457,417, entitled "MOTORIZED RECUMBENT THERAPEUTIC AND EXERCISE DEVICE," filed Feb. 10, 2017, which is incorporated herein by reference in its entirety.

TECHNICAL FIELD

The present disclosure relates to therapeutic and exercise devices. More particularly, the present disclosure relates to a recumbent style therapeutic and exercise device having a hand actuation or crank system and a foot actuation or crank system.

BACKGROUND

Therapeutic devices are used in a variety of manners: from assistive medical devices (e.g., hearing aids, etc.) to physical therapy equipment (e.g., resistance bands), which is often used to rehabilitate injuries. Such physical therapy equipment often relates to equipment intended to work joints and muscles that may be plagued from injury and/or illness. Often, coordinated exercises and in some cases the physical therapy equipment is used to work, stretch, and strengthen the affected body areas. For example, a person with a rotator cuff injury may be instructed to do a prescribed number of arm circles twice a day to stretch and strength the affected rotator cuff. Over time, that person may be instructed to begin to do shoulder presses (i.e., holding a dumbbell and lifting the dumbbell from the person's shoulder to an overhead position) with a relatively low weight to strength the shoulder. The objects of the exercises are to reduce recovery time and to put the person back to a position that they would have been but for the injury. Physical therapy equipment can include walking aids (e.g., walkers and crutches, etc.), exercise devices intended to manipulate or work certain body areas (e.g., a stationary bicycle, etc.), resistance bands, treadmills, and the like.

While physical therapy equipment is primarily intended to rehabilitate injuries or counteract debilitating illnesses, exercise equipment is typically intended to promote the fitness and health of a person. Of course, like physical therapy equipment, exercise equipment is typically directed towards specific muscle groups, such as a bench press being directed to pectoral muscles of a user. Such exercise equipment may be similar to and even include various physical therapy equipment such as treadmills, resistance bands, elliptical machines, a bench press, a squat rack, etc.

SUMMARY

One implementation of the present disclosure is a device for therapy and exercise. The device includes a frame, a base at least partially supporting and extending from the frame, a user support moveably coupled to the base and positioned adjacent the frame, a foot crank system coupled to the frame, a hand crank system coupled to the frame, and a motor coupled to at least one of the foot crank system and the hand crank system. The motor selectively power the at least one foot crank system and the hand crank system in one of an active mode of operation and a passive mode of operation.

In some embodiments, the device for therapy and exercise further includes a display device configured to allow a user to select a mode of operation of the device and to display performance data relating to the mode of operation.

In some embodiments, the device for therapy and exercise further includes a transmission configured to selectively couple the foot crank system and the hand crank system to the motor.

In some embodiments, the foot crank system includes a pair of foot pedals coupled to a pair of pedal arms, a pedal shaft coupled to each of the pair of pedal arms, and a pedal pulley coupled to the pedal shaft, wherein rotation of the pedal pulley causes rotation of the pedal shaft and rotation of the pedal arms and the pedals.

In some embodiments, the hand crank system includes a pair of hand grips coupled to a pair of crank arms, a crank shaft coupled to each of the pair of crank arms, and a crank pulley coupled to the crank shaft, wherein rotation of the crank pulley causes rotation of the crank shaft and rotation of the crank arms and the hand grips.

In some embodiments, the active mode includes a powering sub-mode and a resistance sub-mode.

In some embodiments, operation of the motor in the powering-sub mode includes providing a driving force via the motor to at least one of the foot crank system and the hand crank system to cause a rotation of at least one of the foot crank system and the hand crank system at a predefined speed.

In some embodiments, the motor provides a driving force to both the foot crank and the hand crank system to cause a rotation of the foot crank system and the hand crank system.

In some embodiments, operation of the motor in the resistance sub-mode includes providing a resistive force via the motor to at least one of the foot crank system and the hand crank system.

In some embodiments, the motor provides a resistive force to both the foot crank system and the hand crank system.

In some embodiments, operation of the motor in the passive mode includes providing a powering force via the motor to at least one of the foot crank system and the hand crank system to cause a rotation of at least one of the foot crank system and the hand crank system at a predefined speed.

In some embodiments, the motor provides a powering force to both the foot crank system and the hand crank system to cause a rotation of both the foot crank system and the hand crank system.

In some embodiments, the active mode is configured to provide a specified workout to the user.

In some embodiments, the passive mode is configured to provide a specified therapeutic program to the user.

Another implementation of the present disclosure is device for therapy or exercise. The device includes a frame, a user support coupled to the frame, a foot crank system coupled to the frame, a hand crank system coupled to the frame, and a motor configured to selectively power the foot crank system and the hand crank system in one of an active mode of operation and a passive mode of operation. The active mode includes a powering sub-mode and a resistance sub-mode.

In some embodiments, the device for therapy or exercise further includes a display device coupled to the frame, wherein a user may select via the display device an operation mode of the device.

In some embodiments, operation of the motor in the powering sub-mode provides a driving force to the foot crank system and the hand crank system to cause a rotation of at least one of the foot crank system and the hand crank system at a set speed, wherein the user may select the speed via the display device.

In some embodiments, operation of the motor in the resistive sub-mode provides a resistive force to at least one of the foot crank system and the hand crank system, wherein the user may select a level of resistance via the display device.

In some embodiments, operation of the motor in the passive mode provides a powering force to at least one of the foot crank system and the hand crank system to cause a rotation of at least one of the foot crank system and the hand crank system.

In some embodiments, the device for therapy and exercise further comprises a transmission configured to selectively couple the foot crank system and the hand crank system to the motor.

In some embodiments, the active mode and the passive mode have predefined settings that direct the motor to operate at set speeds and to cause rotation of the foot crank system and hand crank system in set directions for a predefined period of time.

Another implementation of the present disclosure is a method for therapy or exercise. The method includes providing a therapeutic and exercise device, the therapeutic and exercise device having a housing, a base at least partially supporting the housing, and a chair movably coupled to the base. The method further includes providing a foot crank system and a hand crank system coupled to the housing. The method further includes providing a motor configured to selectively power the foot crank system and the hand crank system. The method further includes operating the motor in a first mode of operation, wherein the first mode comprises providing one of a driving force and a resistive force to the foot crank system and the hand crank system via the motor. The method further includes operating the motor in a second mode of operation, wherein the second mode comprises providing a powering force to the foot crank system and the hand crank system via the motor.

DETAILED DESCRIPTION

Figure 1:
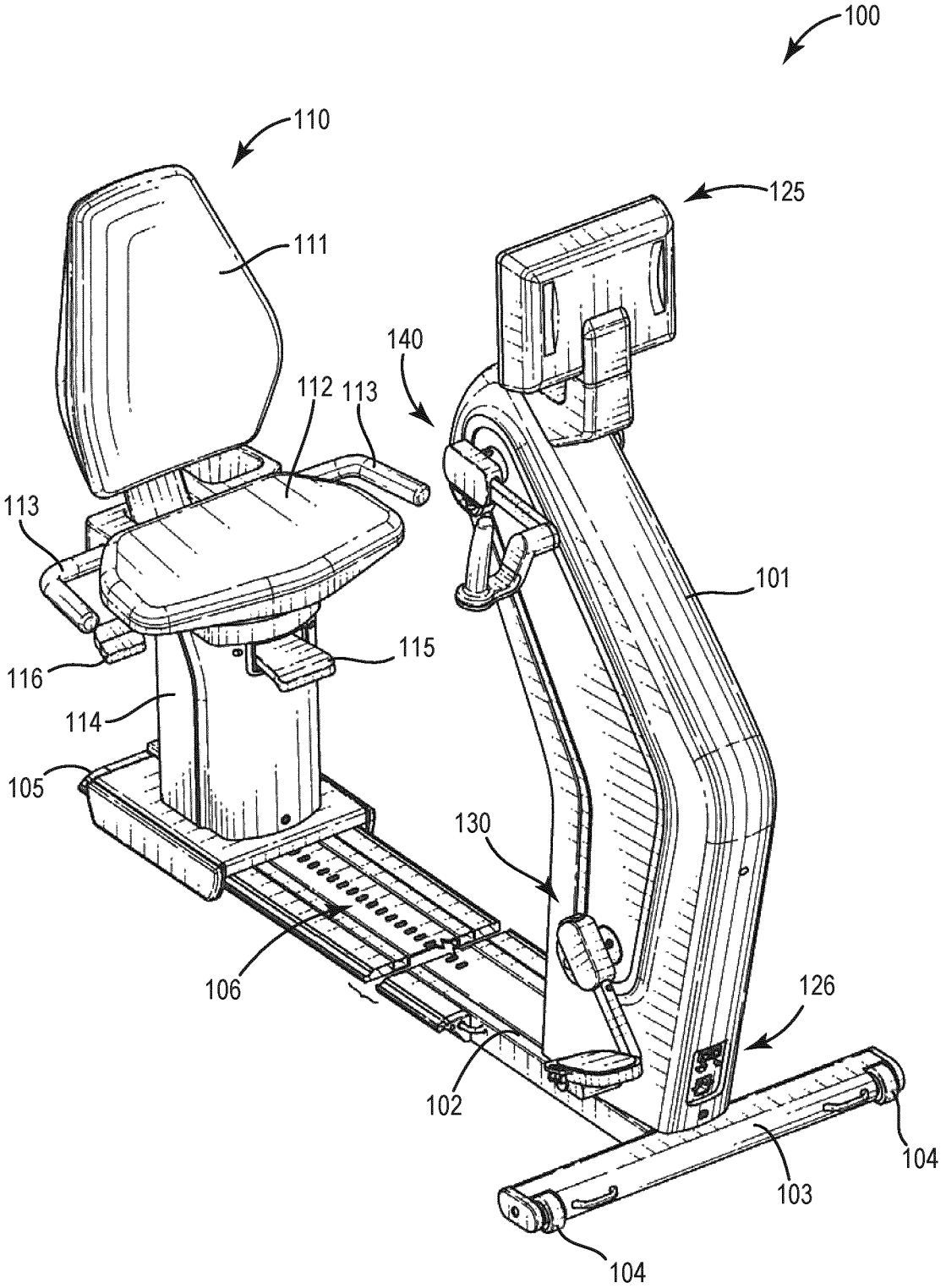
FIG. 1 is a perspective view of a recumbent therapeutic and exercise device, according to an exemplary embodiment.
Figure 2:
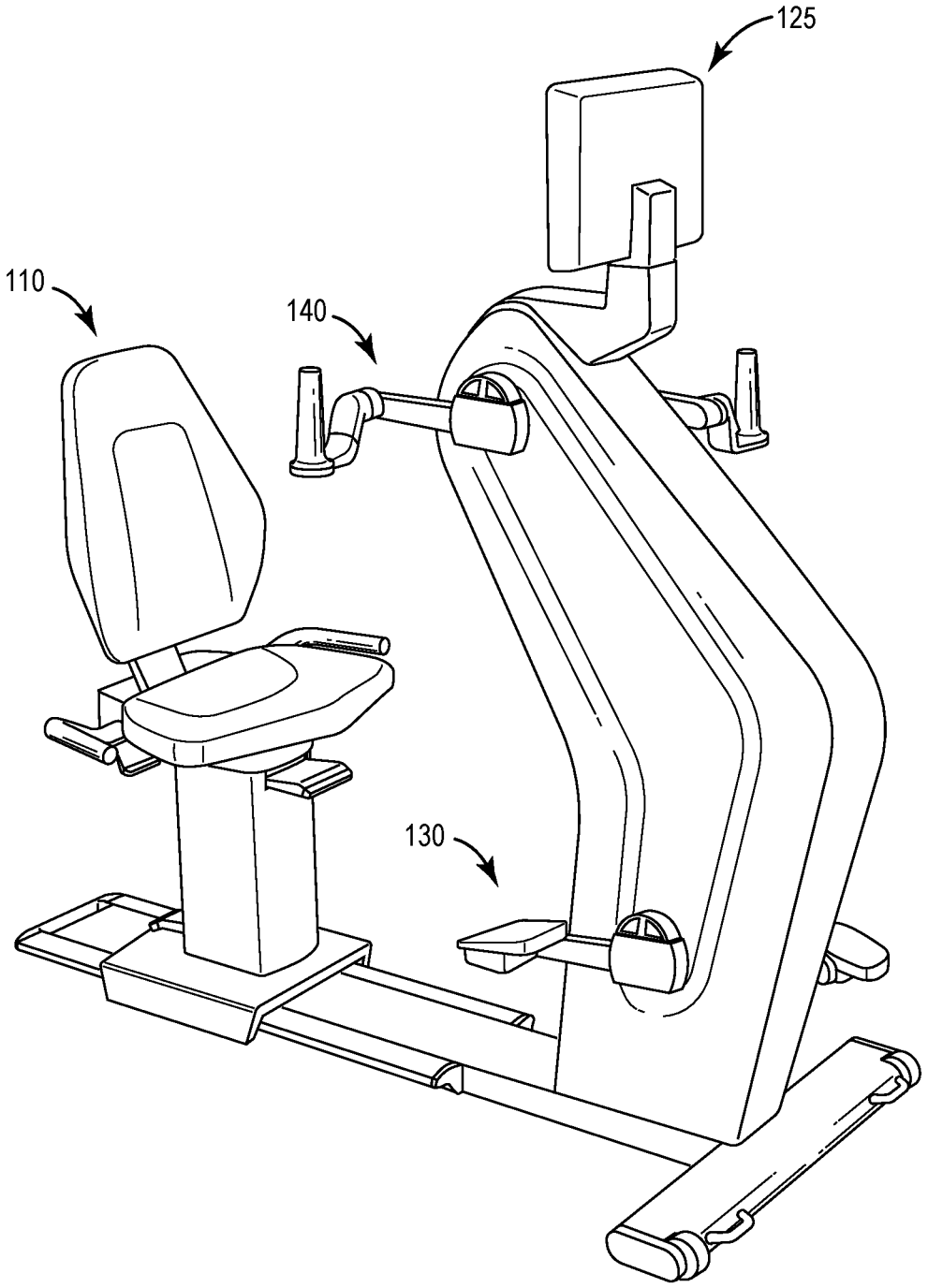
FIG. 2 is another perspective view of the recumbent therapeutic and exercise device of FIG. 1 but shown in a model image as compared to the line drawing in FIG. 1, according to an exemplary embodiment.
Figure 3:
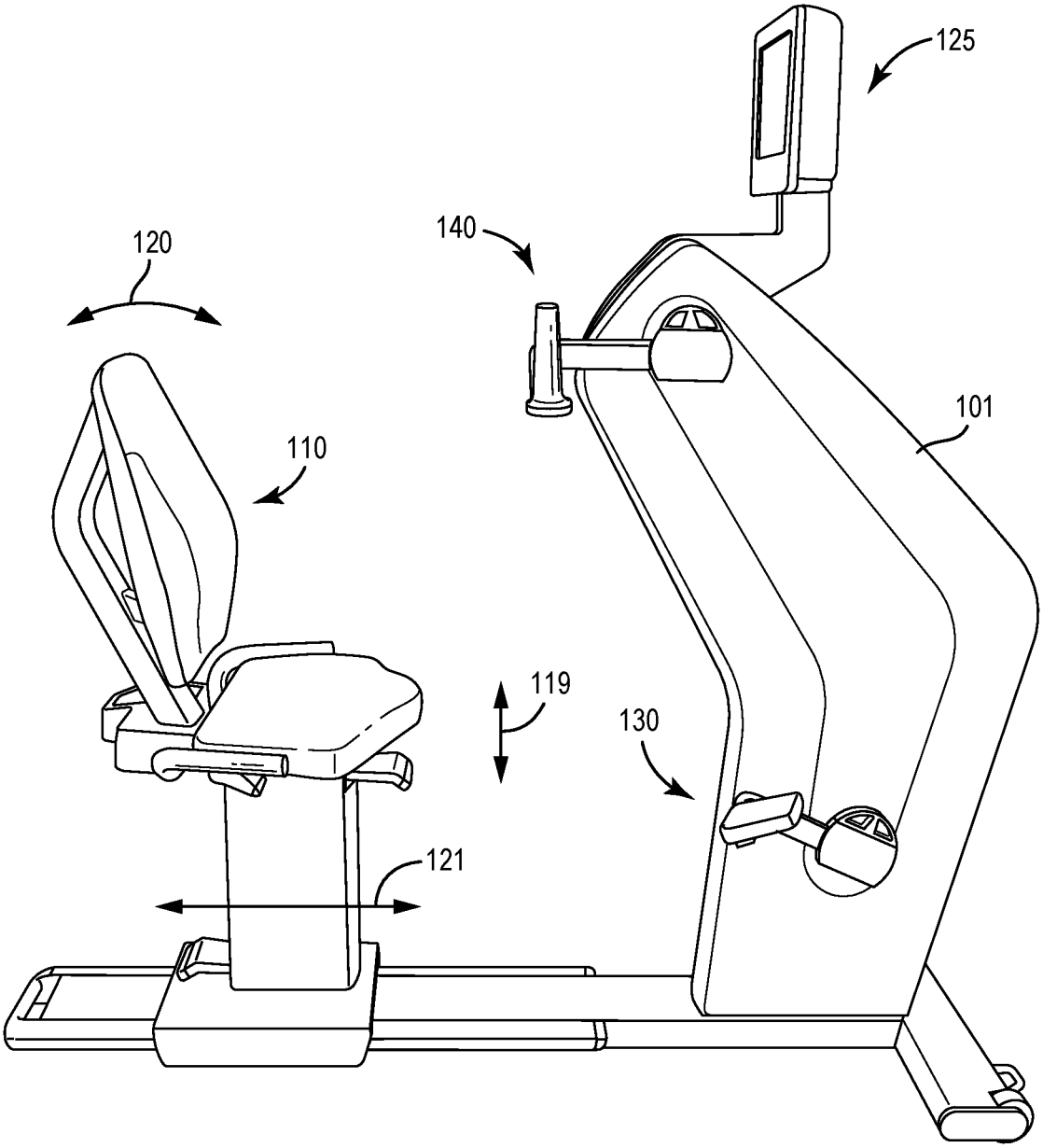
FIG. 3 is a side view of the recumbent therapeutic and exercise device of FIG. 2, according to an exemplary embodiment.
Figure 4:
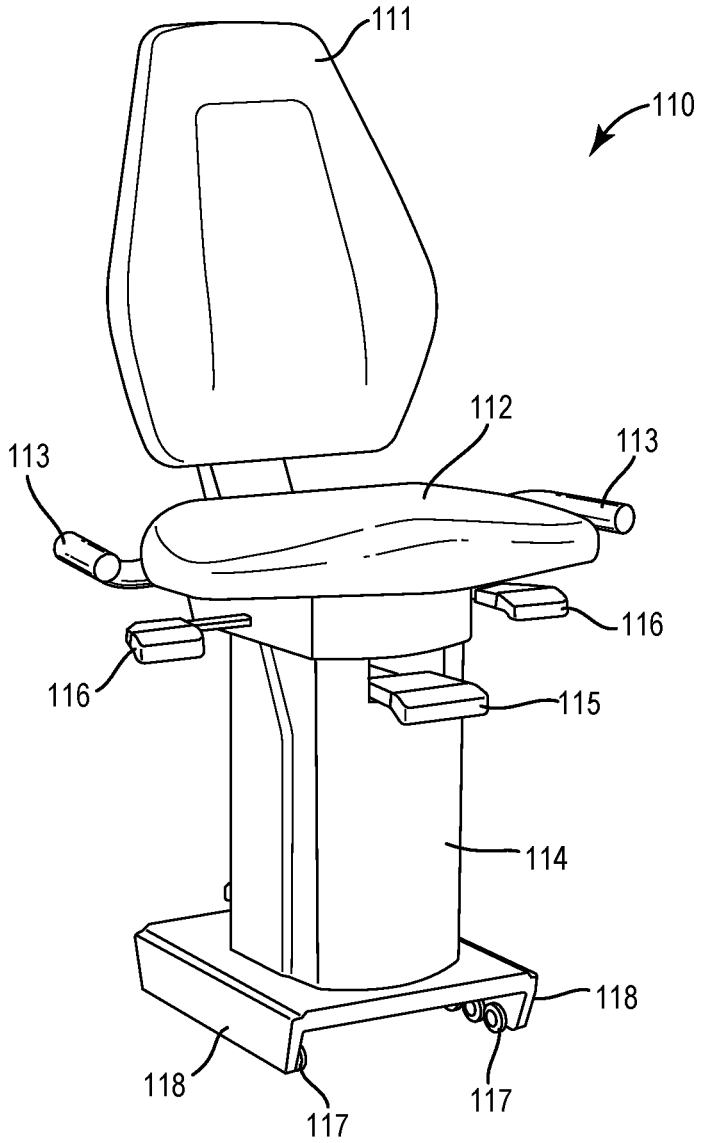
FIGS. 4-6 are perspective (FIG. 4), front (FIG. 5), and top (FIG. 6) views of the chair of the recumbent therapeutic and exercise device of FIG. 2, according to an exemplary embodiment.
Figure 6:
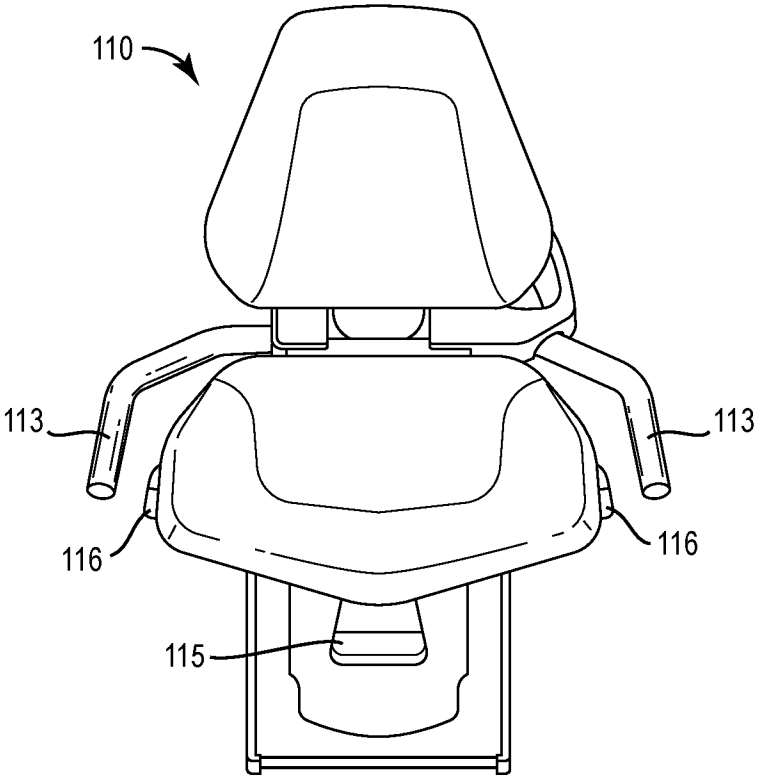
Figure 5:
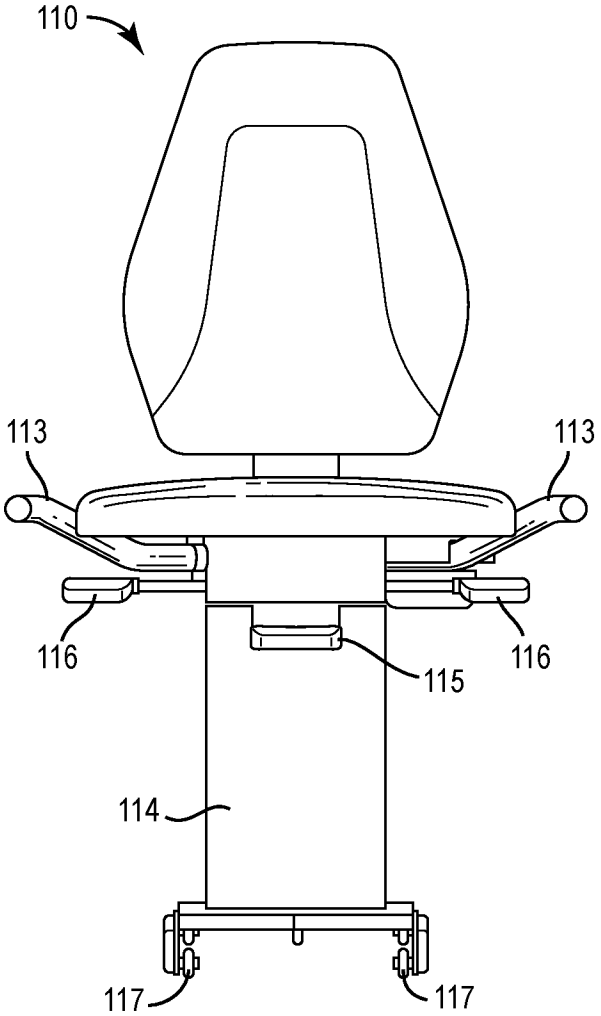

Referring to the Figures generally, a motorized or powered recumbent therapeutic and exercise device is shown herein. According to the present disclosure, the motorized recumbent therapeutic and exercise device includes a housing that shields or covers a frame, a foot crank system coupled to the frame, a hand crank system positioned vertically above the foot crank system and coupled to the frame, a display device configured to (among other functions) output data/information regarding operation of the recumbent therapeutic and exercise device, a chair movable fore and aft relative to the housing, and a motor coupled to the frame and each of the hand crank system and the foot crank system. The motor is operable in an active mode of operation and in a passive mode of operation. In the active mode of operation, the motor provides either i) a motive or driving force to each of the hand crank system and the foot crank system to propel, force, urge, or otherwise drive each of the hand cranks and foot cranks or ii) a resistive or braking force to each of the foot cranks and the hand cranks. As such, the user must either keep up with the driving force (a powering sub-mode of the active mode of operation) or overcome the resistive force (a resistance sub-mode of the active mode of operation). This active mode of operation may be beneficial to a user who desires an exercise-type of workout, where strength training and/or cardiovascular benefit is desired. In comparison, in the passive mode of operation, the motor helps or assists in the rotating or moving of the hand and foot cranks. The passive mode of operation may be used for therapeutic uses (e.g., to provide a specified therapeutic program to the user), where the user desires rehabilitating one or more joints/limbs and needs some assistance in rehabilitating these joints or limbs. In this regard, in the passive mode, the motor does the work to move the limbs of the user to provide the therapeutic benefit to the user. These and other features and benefits are described herein.

Referring now collectively to FIGS. 1-7, a recumbent therapeutic and exercise device 100 (the "device") is shown according to an exemplary embodiment. The device 100 generally includes a housing 101, a base 102 at least partially supporting and extending away from the housing 101, a chair 110 moveably coupled to the base 102, a display device 125, a foot crank system 130, and a hand crank system 140. In operation and as described herein, the user operates the foot cranks of the foot crank system 130 in a circular or bicycle motion with their lower body (e.g., legs and feet). Analogously, the user may operate the hand cranks of the hand crank system 140 in a similar circular motion with their upper body (e.g., hands and arms). As a result and advantageously, the user may simultaneously rehabilitate or exercise their upper body (e.g., joints and muscles in their upper body including shoulders, rotator cuffs, arms in general, etc.) and their lower body (e.g., joints and muscles in their lower body including legs, feet, hip flexors, etc.) while also aerobically exercising using the device 100. Further, the user's abdomen and back may also be engaged to hold themselves in the correct position (e.g., able to operate at least one of the hand crank and foot crank systems), which provides additional exercise and therapeutic or rehabilitation benefit to the user.

Figure 8:
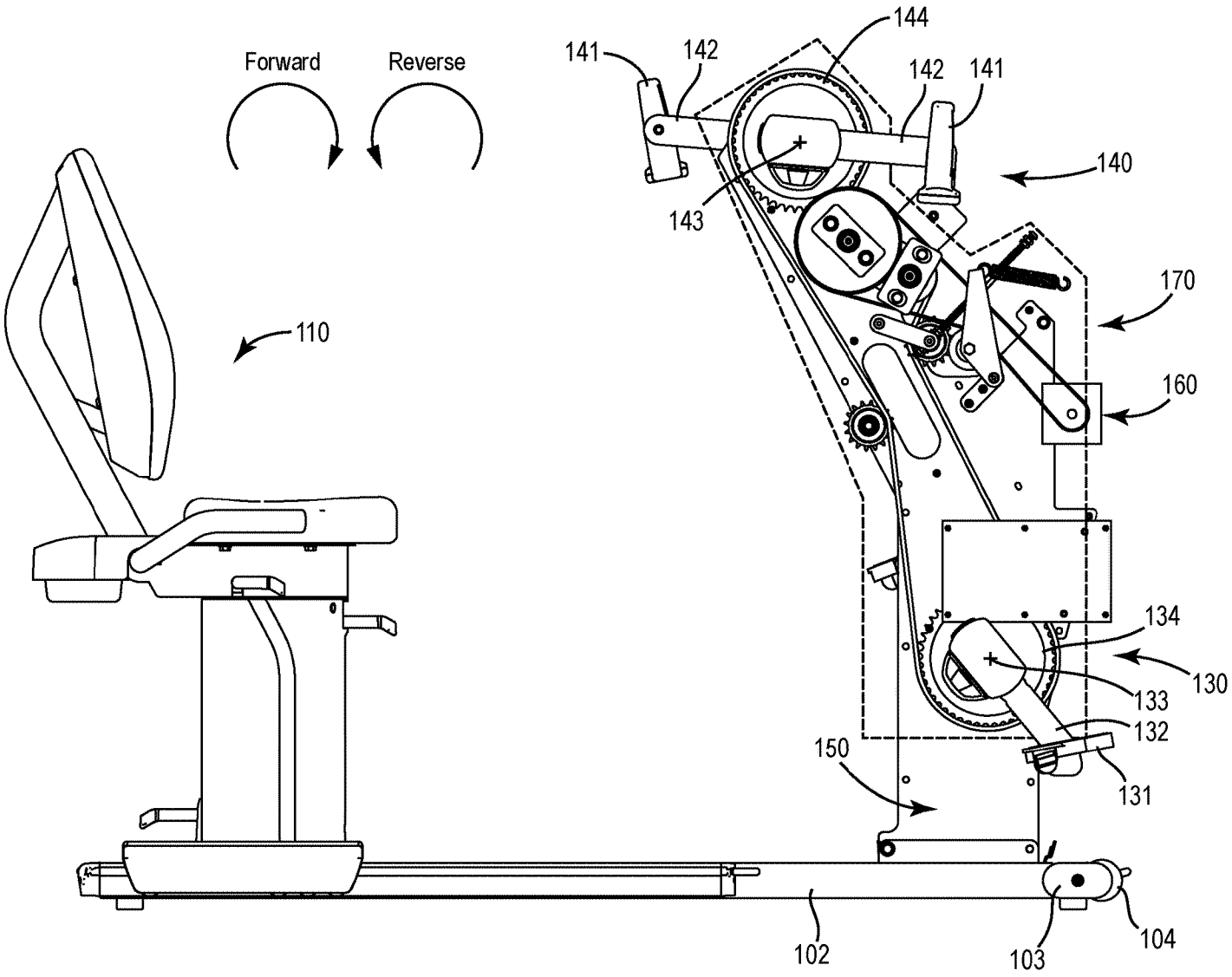
FIG. 8 is a side view of the recumbent therapeutic and exercise device of FIG. 2 with the housing removed to depict the motor and other internal components of the recumbent therapeutic and exercise device, according to an exemplary embodiment.

The housing 101 forms an enclosure to at least partially house, shield, or cover the foot crank system 130, the hand crank system 140, and various internal components of the device 100 such as the motor 160 (see FIG. 8). The housing 101 may be constructed from one component (i.e., be of unitary or integral construction) or constructed from several components. In the example shown, the housing 101 is substantially v-shaped, except that the upper portion of the "v" (i.e., the portion comprising the hand crank system 140) is longer than the corresponding lower power of the "v" (i.e., the portion comprising the foot crank system 130). In this regard, the hand crank system 140 is not only vertically offset, but horizontally offset relative to the foot crank system 130 (i.e., the hand crank system 140 is positioned closer to the chair 110 than the foot crank system 130). In other embodiments, different shapes, curvatures, and relative lengths may be employed with the housing 101 to provide different relative positions between the foot crank system 140 and the hand crank system 130. The housing 101 may be constructed from any material. In one embodiment, the housing 101 is constructed from metal and/or metal alloys. In another embodiment, the housing 101 is constructed from plastic and/or rubber materials in order to decrease weight. In still another embodiment, the housing 101 is constructed from a combination of metal, plastic, rubber, and/or any other materials. Those of ordinary skill in the art will immediately recognize the wide range of the materials that may be used for the construction of the housing 101, with all such materials intended to fall within the spirit and scope of the present disclosure.

The base 102 is coupled to the housing 101 and the chair 110. The base 102 is structured to at least partially support each of the housing 101 and the chair 110 on a support surface for the device 100 (e.g., a ground surface). The base 102 is shown to include a front bar 103 coupled to a pair of wheels 104 (e.g., rollers, casters, etc.), a rear handle 105 positioned longitudinally opposite the front bar 103, and plurality of longitudinally disposed holes 106 (e.g., apertures, voids, openings, etc.). In this regard, "front" designates proximity to the housing 101 while "rear" designates a distal position from the housing 101. To prevent or substantially prevent tippage of the device 100, the front bar 103 extends substantially perpendicularly to the housing 101. Thus, a relatively larger footprint or occupied area of the base 102 is achieved for the device 100 via the front bar 103. The pair of wheels 104 are coupled to the front bar 103 in such a manner that they are spaced apart from a support surface for the device 100 when the device 100 is in a position for use (i.e., where a user may use the hand cranks and/or foot cranks). However, when a user desires to move the device 100, the user may grab the rear handle 105 to lift/raise the rear portion of the device 100 to place the wheels 104 in contact with a support surface, at which point the user may push or pull the device 100 via the handle 105 to move the device 100 into a desired position.

Similarly to the housing 101, the base 102 may be constructed from one component (i.e., be of unitary or integral construction) or constructed from several components. Additionally, the base 102 may be constructed from any material. In one embodiment, the base 102 is constructed from metal and/or metal alloys. In another embodiment, the base 102 is constructed from plastic and/or rubber materials in order to decrease weight. In still another embodiment, the base 102 is constructed from a combination of metal, plastic, rubber, and/or any other materials. Those of ordinary skill in the art will immediately recognize the wide range of the materials that may be used for the construction of the base 102, with all such materials intended to fall within the spirit and scope of the present disclosure.

As mentioned above, the chair 110 (e.g., user support, user support structure, or user support device) is movably coupled to the base 102 and configured to receive a user of the device 100. The chair 110 is shown to include a back rest 111, a seat 112, handlebars 113 adjacent the seat 112, a support member 114 projecting downward from the seat 113, a lever 115 configured to adjust a vertical height of the chair 100 (i.e., the height or distance between the seat 112 and the base 102), another lever 116, and wheels 117 coupled to a pair of blocks 118. As shown, each block 118 is coupled to the support member 114 and is disposed on opposite sides of the base 102. The support member 114 is shown as a generally rectangular column coupled to the seat 112 and back rest 111. In other embodiments, the support member 114 may be of other configurations, such as a generally circular column. Coupling may be via any type of fastener (e.g., bolts, etc.) or bonding technique. In certain embodiments, one or more of the components of the chair 110 may be of unitary construction. Further, the back rest 111 and seat 112 may include any type of cushioning to increase the comfort of the user. Moreover, the shape of the back rest 111 and seat 112 is highly configurable with all such variations intended to fall within the scope of the present disclosure (e.g., a tear drop shaped back rest, a square seat, a "w" shaped seat, etc.).

In the example depicted, the chair 110 includes mechanisms to adjust the vertical height of the chair 110 (i.e., the distance between the seat 112 to the base 102), and the relative position of the chair 110 to the housing 110. In certain embodiments, the back rest 111 may be angularly adjustable as well, such that, in this embodiment, the chair 110 include three degrees of freedom of movement, which are shown as reference numbers 119 (vertical height adjustment of the chair 110), 120 (angular adjustment of the back rest 111), and 121 (horizontal adjustment of the chair 110 relative to the housing 101)(see FIG. 3). In regard to the vertical adjustment mechanism, the lever 115 may be actuated, moved, or otherwise controlled by a user to selectively adjust the height of the chair 110. Any type of vertical adjustment mechanism may be used. In one embodiment, the lever 115 may actuate/move a pin into and out of a hole, such that a user may lift or pull the seat 112 upward (away from the base 102) and once a desired height is reached, the user may move the lever 115 to insert a pin or other projecting member into an aperture or hole. Thus, the chair 110 includes a telescoping aspect whereby an inner structure moves relative to an outer structure (i.e., the support member 114). This represents a manually-actuated vertical adjustment mechanism. In another embodiment and in the example shown, a gas-spring mechanism is utilized. The gas-spring (not shown) is located within the support member 114 and selectively applies a force to the seat 112 to move the seat 112 and back rest 113 relative to the support member 114 in a vertical direction. In operation, the user moves or actuates the lever 115 to controllably inflate/deflate the gas-spring to adjust the height of the chair 110. In yet another embodiment, any type of vertical adjustment mechanism may be used.

In regard to the horizontal movement capability of the chair 110, the chair 110 is shown to include wheels 117 that engage with the base 102 to permit a rolling movement of the chair 110 relative to the base 102 and a fore and aft movement relative to the housing 101. In particular, each block of the blocks 118 substantially overlaps a side of the base 102, such that the wheels 117 coupled to each block 118 engage with a channel or other surface of the base 102. As a result, the wheels 117 may roll upon the surface of the base 102 to enable the chair 110 to roll or move closer to or further from the housing 101. In the example shown, the base 102 defines a plurality of holes 106 (e.g., apertures, voids, openings, etc.) positioned in various positions longitudinally across a top surface of the base 102. The plurality of apertures 106 function as half a chair retaining mechanism for the chair 110. The other half of the chair retaining mechanism is disposed on the chair 110 as a retainer (e.g., releasable bolt, pin, etc.). The retainer may be spring-loaded and be at least partially received in one of the plurality of apertures 106 after the chair 106 is positioned in its desired horizontal position relative to the housing 101. In operation, a user may control the lever 116 to actuate the retainer of the chair 110 into and out of an aperture in the plurality of apertures 106. When the desired relative position of the chair 110 is found/reached, the user releases or engages the retainer via actuation of the lever 116 with one of the apertures 106 to secure or lock the chair 110 in a desired position relative to the housing 101. In this regard, the relative positioning of the chair 110 to the housing 101 may be adjusted to selectively vary the length between a user and each of the foot crank system 130 and the hand crank system 140 to, in turn, accommodate users of various sizes (e.g., heights). It should be understood that while the horizontal movement mechanism of the chair 110 is described herein as wheels that engage with a support surface of the base, this mechanism is not meant to be limiting as a variety of other mechanisms may also be used with all such variations intended to fall within the scope of the present disclosure (e.g., the blocks may be simply received in corresponding channels of the base and slide therein, etc.).

It should also be understood that the aforementioned description of the movement capabilities of the chair 110 is not meant to be limiting. In some embodiments, the seat 112 and back rest 111 of the chair 110 may swivel or rotate relative to the support member 114. Rotational control of the seat and back rest may be achieved by a lever or another control mechanism provided with the chair. Thus, many different movement capabilities of the chair are possible with all such variations intended to fall within the scope of the present disclosure.

A number of devices, both mechanical and electrical, may be used in conjunction with or in cooperation with a device 100. FIGS. 1-7, for example, show a display device 125 adapted to display performance data relating to operation of the device 100 according to an exemplary embodiment. The display device 125 may include any type of display device including, but not limited to, a touchscreen display device, physical input devices in combination with the display screen, and so on. The data outputted by the display device 125 may include, but are not limited to, speed, time, distance, calories burned, heart rate, etc. For example, in some embodiments, power meters may be included with the hand cranks and/or foot cranks for a user to track their generated power, via the display device 125.

The display device 125 may include an integrated power source (e.g., a battery), or be electrically coupleable to an external power source (e.g., via an electrical cord that may be plugged into a wall outlet). In the example shown, the device 100 is shown to include a connection panel 126 (e.g., port panel, etc.) configured to enable the electrical coupling of the device 100 to an external power source as well as to potentially other items, such as a cable television line. The external power source provides electrical power to various electronic components on the device, such as the display device 125 and the motor 160. Additionally, the connection panel 126 may have any combination of ports, jacks, power receptacles and the like, which may include, but are not limited to, an AV port, a HDMI input, a USB input, a coaxial cable input, etc.

In addition to the jacks and ports provided in the connection panel 126, the display device 125 may also include one or more input jacks (e.g., a USB input, ear plugs/headphones, an HDMI input, etc.) that receive an electronic device of the user (e.g., mobile phone, etc.) such that the display device 125 may broadcast media content from that electronic device of the user. The one or more input jacks may also enable bi-directional communication, such that a user may download their workout or exercise summary to their electronic device for tracking purposes. According to other exemplary embodiments, other displays, cup holders, cargo nets, heart rate grips, arm exercisers, TV mounting devices, user worktops, and/or other devices may be incorporated into the device 100. For example, heart rate grips may be disposed on one or both hand cranks of the hand crank system 140, or on the handlebars 113, or in another location whereby the heart rate grips are configured to acquire data indicative of a heart rate of a user.

As shown, the display device 125 is coupled to the housing 101 and disposed vertically above the hand crank system 140. However, in other embodiments, the display device 125 may be positioned in a variety of other positions, such that this positioning is not meant to be limiting (e.g., in the approximate middle of the hand crank system 140 on the housing 101, on a side of the housing 101, etc.).

Figure 7:
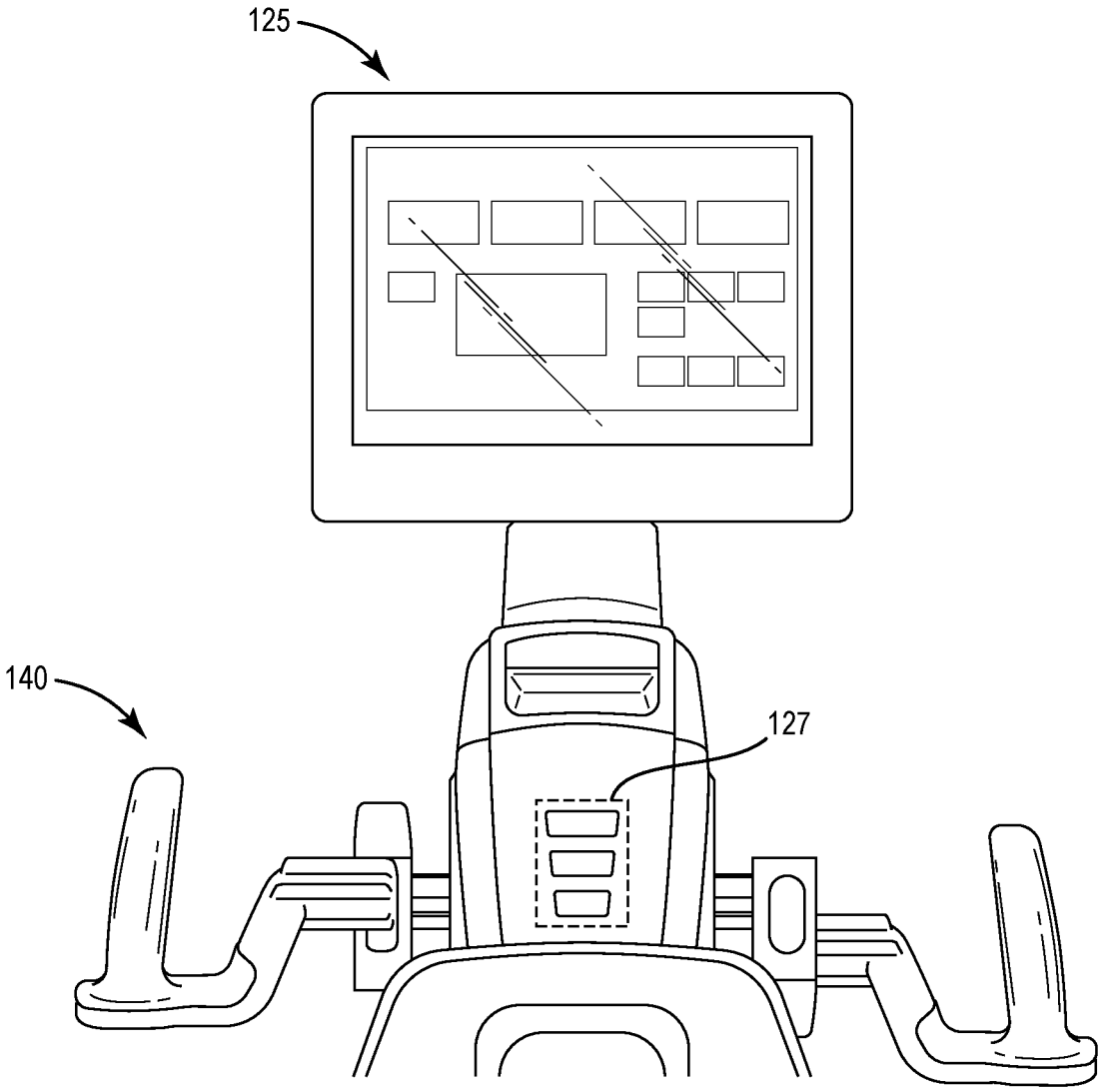
FIG. 7 is a close-up view of the display device and hand crank system of the recumbent therapeutic and exercise device of FIG. 2, according to an exemplary embodiment.

As shown particularly in FIG. 7, the device 100 includes a control panel 127. The control panel 127 is one or more buttons, levers, switches, and the like that enable a user to control various aspects of the device 100. For example, circuitry may couple the control panel 127 to, e.g., a motor controller 208 of the motor 160 to control activation/deactivation of the active and passive modes of operation. As another example, circuitry may couple the control panel 127 to the display device 125 for turning or powering on (or off) the display device 125 and the device 100 in general (e.g., the motor controller 208, the motor 160, etc.). As yet another example, a quick start button may be provided in the control panel 127 that enables to start using the device 100 immediately without having to, e.g., select a workout or therapeutic routine. In this regard, it should be understood that user control features may be disposed on the display device 125 itself (e.g., as touchscreen features or buttons disposed near the screen) as well as in other positions on the device 100, such as on the housing 101 like the control panel 127. Of course, the positioning of the control panel 127 is not meant to be limiting as other control features may be positioned in various other positions with all such locations intended to fall within the scope of the present disclosure (e.g., on the handlebars of the chair 110, excluded from the device 100 such that all the control features on the display device 125, on the side of the housing 101, etc.).

The hand crank and foot crank systems 130 and 140, respectively, are structured to enable a user to engage in therapeutic and/or exercise activity with the device 100. In the example shown, the vertical and horizontal positions of the hand crank system 140 and the foot crank system 130 are stationary or fixed relative to the housing 101. In this regard, the user adjusts the vertical and horizontal positioning of the chair 110 relative to the housing 101 to achieve a comfortable position with respect to the foot crank system 130 and the hand crank system 140. In other embodiments, one or both of the foot crank system 130 and the hand crank system 140 may be movable relative to the housing 101 to further help achieve a comfortable position for the user for the device 100.

Referring now to FIG. 8, a side view of the recumbent therapeutic and exercise device 100 with the housing 101 removed to depict the motor 160 and other internal components of the recumbent therapeutic and exercise device 100, according to an exemplary embodiment. In this regard and as shown, the device 100 includes a frame 150, a motor 160, and a transmission 170. Before turning to the motor 160 and transmission 170, the hand crank system 140 and foot crank system 130 are firstly described in more detail.

The foot crank system 130 (also referred to as the foot crank assembly) is coupled to the frame 150 and generally includes a pair of foot pedals 131 coupled to a pair of arms 132 (pedal arms) (where one arm is coupled to one pedal), a shaft 133 coupled to each arm in the pair of arms 132, and a pulley 134. The shaft 133 (e.g., rod, axle, pedal shaft etc.) may be coupled to each arm 132 in any suitable fashion (e.g., interference fit, a bonding agent, etc.). The pulley 134 (e.g., gear, pedal pulley, etc.) may also be coupled to the shaft 133 in any suitable manner (e.g., a key and keyway, press-fit, etc.). Due to the coupling and in operation, rotation of the pulley 134 causes rotation of the shaft 133, which in turn causes rotation of the arms 132 and pedals 131.

Collectively, each pedal 131 and arm 132 combination may be referred to as a "foot crank" due to this combination representing a crank or moment arm on the shaft 133. Each foot crank may move or rotate about a center axis of the shaft 133. Rotation of the foot cranks causes rotational movement of the shaft 133. In some embodiments, each pedal 131 may move or rotate relative to each arm 132; in other alternative embodiments, the pedals 131 may be fixed relative to the arms 132. Each pedal 131 is adapted to receive a foot of the user. In this regard, each pedal 131 may also include any number and type of adjustment mechanisms for securely or relatively securely holding each foot, such as a strap(s), clip(s), etc. Beneficially, the use of adjustment mechanisms may enable the pedals 131 to accommodate a wide variety of foot sizes of users.

The hand crank system 140 (also referred to as the hand cranks assembly) is coupled to the frame 150 and generally includes a pair of hand grips 141 coupled to a pair of arms 142 (crank arms) (where one arm is coupled to one grip), a shaft 143 coupled to each arm in the pair of arms 142, and a pulley 144. The shaft 143 (e.g., rod, axle, crank shaft, etc.) may be coupled to each arm 142 in any suitable fashion (e.g., interference fit, a bonding agent, etc.). The pulley 144 (e.g., gear, etc.) may also be coupled to the shaft 143 in any suitable manner (e.g., a key and keyway, press-fit, etc.). Due to the coupling and in operation, rotation of the pulley 144 causes rotation of the shaft 143, which in turn causes rotation of the arms 142 and grips 141.

Collectively, each grip 141 and arm 142 combination may be referred to as a "hand crank" due to this combination representing a crank or moment arm for the shaft 143. Each hand crank may move or rotate about a center axis of the shaft 143. Rotation of the hand cranks causes rotational movement of the shaft 143. In some embodiments, each grip 141 may move or rotate relative to each arm 142; in other alternative embodiments, the grips 141 may be fixed relative to the arms 142. Each grip 141 is adapted to receive a hand of the user (i.e., for the user to hold/grab) and move relative to each respective arm 142. Thus, many different sizes and shapes of the grips 141 are possible (e.g., a conical shape, ridges to receive fingers of the users, a cylindrical shape, etc.). Further, each grip 141 may include any number and type of adjustment mechanisms for securely or relatively securely holding each hand, such as a strap(s). Additionally, a variety of materials may be use with the grips 141 to facilitate a more comfortable engagement point for the user (e.g., a rubberized grip, etc.). Beneficially, the use of adjustment mechanisms may enable the grips 141 to accommodate a wide variety of hand sizes of users.

In operation, a user may adjust the height of the chair 110 and the distance of the chair 110 to the housing 101 to accommodate his/her size. Once positioned, the user may sit upon the seat 112, grip each of the grips 141 with each of their hands, and place each of their feet on or in each of the pedals 131. The user may then simultaneously rotate the foot and hand cranks. Rotation of the foot and hand cranks may provide an aerobic exercise and help to strengthen various upper body and lower body muscles. In certain configurations, the user may desire to only work out their arms or their legs. At which point, he or she may only actuate, rotate, or otherwise move one of the foot cranks and hand cranks. In some instances, the user may position the chair an extended distance away from the housing 101 and use the device 100 without sitting on the chair 110 (e.g., from a standing position to actuate the hand cranks).

Referring still to FIG. 8 in combination with FIGS. 1-7, the frame 150 is coupled to the base 102, the foot crank system 130, the hand crank system 140, and the motor 160. In the example shown, the frame 150 is an assembly of components that serve as a support structure, at least in part, for each of the foot crank system 130, hand crank system 140, and the motor 160. In other embodiments, the frame 150 may be a unitary or one-piece component. The frame 150 may be constructed from any suitable material including, but not limited, metal, metal alloys, plastics, rubbers, any combination thereof, and the like.

The transmission 170 is structured to couple the motor 160 to each of the hand crank system 140 and the foot crank system 130. The transmission 170 couples the hand crank system 140 to the foot crank system 130, such that when a user operates the hand cranks, the foot cranks rotate in the same direction. For example, if the user rotates the hand cranks in the forward direction, the foot cranks are driven in the forward direction. The vice versa is also true: if the user operates or drives the foot cranks in, e.g., the forward direction, the hand cranks rotate in the forward direction. Thus, the transmission 170 rotatably couples the hand cranks to the foot cranks, such that the hand cranks and foot cranks rotate in the same direction/in unison.

According to the example shown, the transmission 170 is also structured to enable the hand cranks and foot cranks to rotate at the same or substantially the same rotational speed. Thus, the transmission 170 enables the hand cranks and foot cranks to rotate in unison and at approximately or substantially the same rotational speed. However, in other embodiments, various speed differential mechanisms may be implemented with the transmission 170 to enable different relative rotational speeds between the hand cranks and the foot cranks. For example, in one embodiment, the pulley 134 is larger than the pulley 144 such that the pulley 144 (and, in turn, the hand cranks 144) has a higher rotational speed than the pulley 134 and the foot cranks. In another embodiment, the pulley 144 is larger than the pulley 134 such that the hand cranks have a slower rotational speed than the foot cranks. It should be understood that in other embodiments, various other and different differential speed mechanisms may be implemented with the device 100 with all such variations intended to fall within the scope of the present disclosure.

To facilitate the rotatable coupling between the motor 160, the hand crank system 140, and the foot crank system 130, the transmission 170 is shown to include a variety of belts, shaft assemblies having one or more pulleys and bearings (e.g., regular bearings, one-way bearings, etc.), springs, and tension assemblies. It should be understood that this depiction is not meant to be limiting as the transmission 170 may also include, in place of or in addition to the aforementioned elements, various gears, chains, etc. The belts may include any type of belt including, but not limited to, toothed belts, v-shaped belts, substantially smooth belts, etc. The pulleys may have a corresponding shape to each of the belts, such that pulleys may include, but are not limited to, a v-shaped pulley, toothed pulley, etc. Tension assemblies may be coupled to the frame 150 and structured to apply a tension to the belts. In certain embodiments, the tensioners may be movable to provide an adjustable amount of tension to one or more belts. In the example shown, a single belt (i.e., the coupling belt) engages with each of the pulley 134 and the pulley 144. As such, this single belt enables the pulleys 134, 144 to rotate in the same direction. As shown, the motor 160 engages with or drives another belt (i.e., the power transfer belt). The power transfer belt is rotatably coupled, via one or more pulleys and belts, to the coupling belt to, in turn, transfer power or motive force from the motor 160 to the coupling belt and therefore to each of the hand crank system 140 and the foot crank system 130.

Turning now to the motor 160, the motor 160 is coupled to the frame 150, and is structured to selectively i) power, drive, move, or otherwise impart a force onto each of the hand crank system 140 and the foot crank system 130 in order to drive, power, and/or otherwise rotate each of the hand cranks and the foot cranks, and ii) provide a resistive or braking force to the movement of each of the hand cranks and foot cranks in accordance with each of the active and passive modes of operation. As shown, the motor 160 is coupled to the frame 150, such that the frame 150 may support or at least partially support the motor 160 while the housing 101 covers or shields the motor 160. In the example shown, the motor 160 is disposed vertically closer to the foot crank system 130 than to the hand crank system 140. However, in other embodiments, the motor 160 may be disposed in any position in the device 100.

The motor 160 may be structured as any type of motor that may be used to selectively power (e.g., impart force) to the foot crank system 130 and the hand crank system 140. In this regard, the motor 160 may be an alternating current (AC) motor or a direct current (DC) motor and be of any power rating desired. In one embodiment and as shown, the motor 160 is structured as brushless DC motor in order to be able to selectively provide a driving force which is useable in the active mode and a holding torque, which is useable in the various modes of operation, which are described in more detail herein below. The motor 160 may be solely a motor or be a motor/generator combination unit (i.e., capable of generating electricity). Further, the motor 160 may receive electrical power from an external source (e.g., from a wall outlet) or from a power source integrated into the device 100, such as a battery. In the example shown, the connection panel 126 includes an outlet/receptacle for electrically coupling to an external power source, such as a wall outlet. The wall outlet transfers electrical power to the connection panel 126, which transfers electrical power to various electronic components in/on the device 100, such as the motor 160. Accordingly, various electronic filtering components, such as filters, inverters, transformers, relays, and other circuitry components, may be implemented with the device 100 to enable the correct or substantially the correct amount of power being delivered to each specific component. That said, in certain embodiments, one or more electrical components in/on the device 100 may include an integrated power source (e.g., a capacitor, a battery, etc.), such that those components may be powered independent of the power from the external power source. Those of ordinary skill in the art will appreciate the high configurability of powering one or more components on the device 100 with all such variations intended to fall within the scope of the present disclosure.

It should be understood that the motor 160 may have a variety of specifications particular to a DC motor including, but not limited to, the no load speed, the power rating (i.e., the power output capability of the motor), the stall torque (i.e., the maximum torque that the motor can provide with the output shaft of motor not rotating), the holding torque, the torque output capability (e.g., how much torque is capable of being provided at various speeds), the stall current, etc. Thus, modifying the power rating and the torque output capability may affect the capabilities of the active mode of operation. For example, a motor with a greater torque output enables the resistance provided during the resistance sub-mode of operation to be greater than for a motor with a lower torque output rating. Additionally, a user may be provided with more resistance options with this motor than with a motor with a lower torque output rating Further, increasing the power rating may result in the motor being able to achieve relatively higher rotational speeds of the hand cranks and foot cranks as compared to a motor with a lower power rating. As such, it should be understood that the exact specifications of the motor are highly variable. In this regard, the innovations of the present disclosure may be implemented in various models of the device 100, such as an economy model and a performance model. As such, the performance model may include a relatively greater power rating and torque output rating motor as compared to the economy model.

Figure 9:
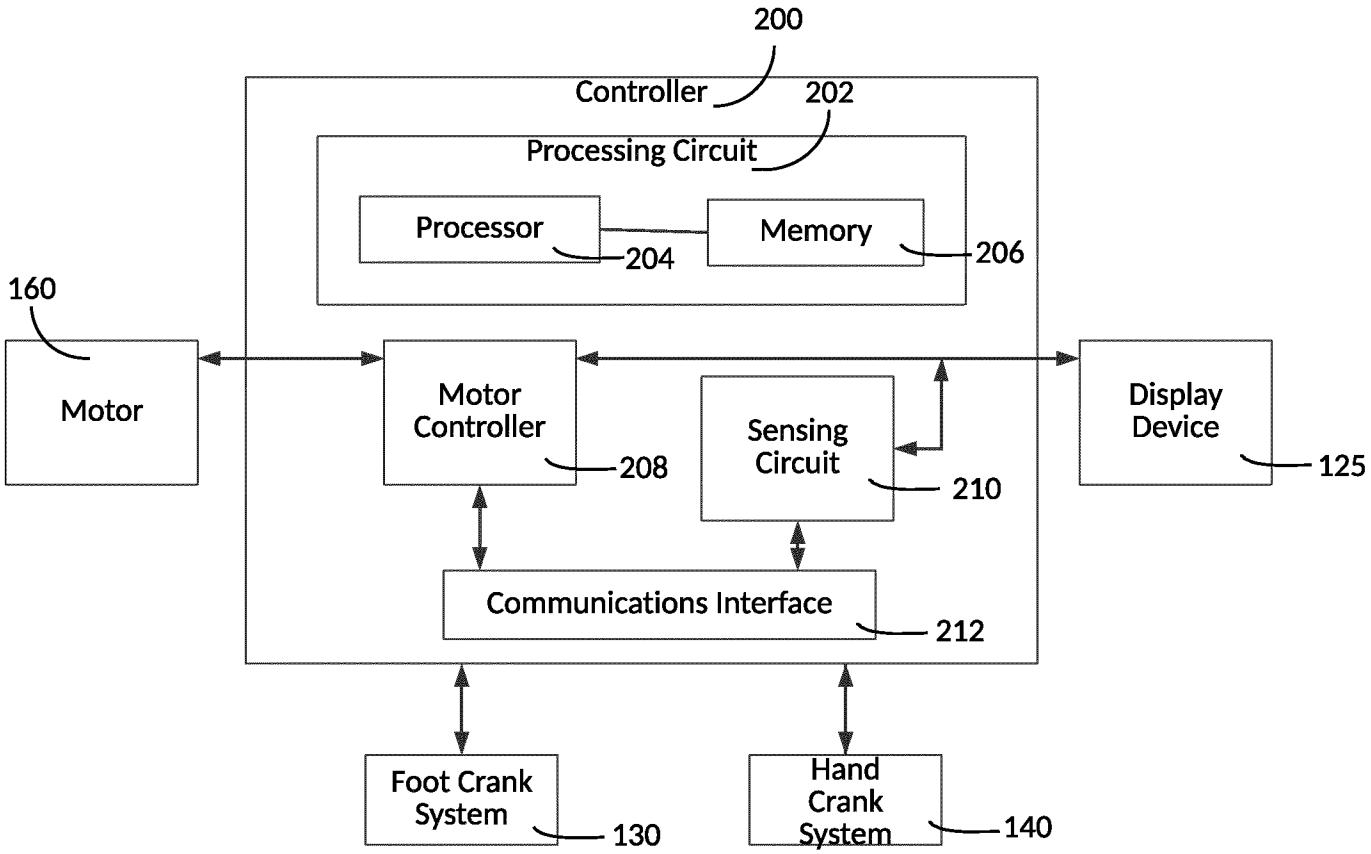
FIG. 9 is a schematic block diagram of a controller which may be used with the recumbent therapeutic and exercise device of FIGS. 1-8, according to an exemplary embodiment.

The motor 160 may also include a motor controller 208. Referring now to FIG. 9, a block diagram of a control system 200 (also referred to as controller 200) is shown, according to an example embodiment. The controller 200 includes a processing circuit 202 having a processor 204 and a memory 206, a motor controller 208, a sensing circuit 210, and a communications interface 212. Processor 204 may be implemented as one or more general-purpose processors, an application specific integrated circuit (ASIC), one or more field programmable gate arrays (FPGAs), a digital signal processor (DSP), a group of processing components, or other suitable electronic processing components. Processor 204 is configured to execute computer code or instructions stored in memory 206 or received from other computer readable media (e.g., CDROM, network storage, a remote server, etc.). Memory 206 (e.g., NVRAM, RAM, ROM, Flash Memory, hard disk storage, etc.) may store data and/or computer code for facilitating at least some of the various processes described herein. Memory 206 may include one or more devices (e.g. memory units, memory devices, storage device, etc.) for storing data and/or computer code and/or facilitating at least some of the various processes described in the present disclosure. In this regard, the memory 206 may include tangible, non-transient computer-readable medium. Memory 206 may be communicably connected to processor 204 via processing circuit 202 and may include computer code for executing (e.g., by processor 204) one or more processes described herein. When processor 204 executes instructions stored in memory 206, processor 206 generally configures controller 200 to complete such activities.

Motor controller 208 can be configured to control operation of motor 160. The control signals provided to motor 160 can cause motor 160 to activate, deactivate, or achieve a variable capacity or speed or torque of the motor 160. Motor controller 208 may be operatively and communicably coupled to a user control feature (e.g., the display device 125 and/or the control panel 127) to enable the user to control various aspects of the motor 160. Motor 160 is coupled to foot crank system 130 and hand crank system 140 to cause rotation or resistance to one or both. Display device 125 may be used to select a program stored in memory 206, which instructs motor 160 to operate at pre-programmed conditions via motor controller 208.

The communications interface 212 may include any combination of wired or wireless interfaces (e.g. jacks, antennas, transmitters, receivers, transceivers, wire terminals, etc.) for conducting data communications with various system, devices, or networks. For example, communications interface 212 may include an Ethernet card and port for sending and receiving data via an Ethernet-based communications network and/or a Wi-Fi transceiver for communication with the plurality sensors located in foot crank system 130 and hand crank system 140. The communications interface 212 may facilitate and enable the communicable coupling of the motor controller 208 with the motor 160 and the sensing circuit 210 with the input/output devices of the device 100. In certain embodiments, the communications interface 212 may enable the coupling of the device 100 with a remote controller or operator, such that workout or therapeutic routines can be received remotely (e.g., at a distance or away) from the device 100.

The sensing circuit 210 is structured to receive signals, information, data, or values (e.g., patient data such as heart rate) regarding operation of the device. In particular, sensing circuit 210 may receive data from the plurality of sensors located within foot crank system 130 and hand crank system 140. The data may be received in real time or near real time. The sensing circuit 210 is coupled to display device 125 such that the received data from the foot crank system 130 and hand crank system 140 may be displayed via display device 125 in real time or near real time. Additionally and as described herein, the sensing circuit 210 may be structured to perform various operations on the data. For example, the data acquired via the heart rate sensor(s) may be transformed by the sensing circuit 210 to show a trend for the user of the device. Thus, the sensing circuit 210 may include one or more algorithms, processes, formulas, and the like that facilitate and enable transformation of the data to various desired output, which may be provided to the display device for display to the user of the device 100.

As shown, the motor controller 208 and sensing circuit 210 are a part of the control system 200. In other embodiment, the motor controller and/or sensing circuit 210 may be separate, discrete components relative to each other and the control system 200. In this regard and in this configuration, at least one of the motor controller 208 and sensing circuit 210 may be positioned in different locations within the device 100.

It should be understood that the structures of the motor controller 208 and sensing circuit 210 are highly configurable. In one configuration, one or both of the sensing circuit 210 and motor controller 208 are discrete processing components (e.g., each includes one or more of various processing components (e.g., processing and memory components, whereby the processor and memory may have the same or similar configuration as described above with respect to the memory 206 and processor 204)), and may be structured as described above, such as one or more e.g., a microcontroller (s), integrated circuit(s), system(s) on a chip, etc. In another embodiment, one or more both of the sensing circuit 210 and motor controller 208 may be structured as machine-readable media (e.g., non-transient computer readable medium that stores instructions that are executable by a processor or processors to perform at least some of the processes herein) that may be stored in the memory 206 and executable by the processor. This latter configuration may be appealable because of the "all-in-one" characteristic. In the example shown, the motor controller 208 is structured as a discrete processing component (described above) while the sensing circuit 210 is structured as machine-readable media. However and in the spirit of the disclosure herein, this exemplary configuration is not meant to be limiting.

Figure 10:
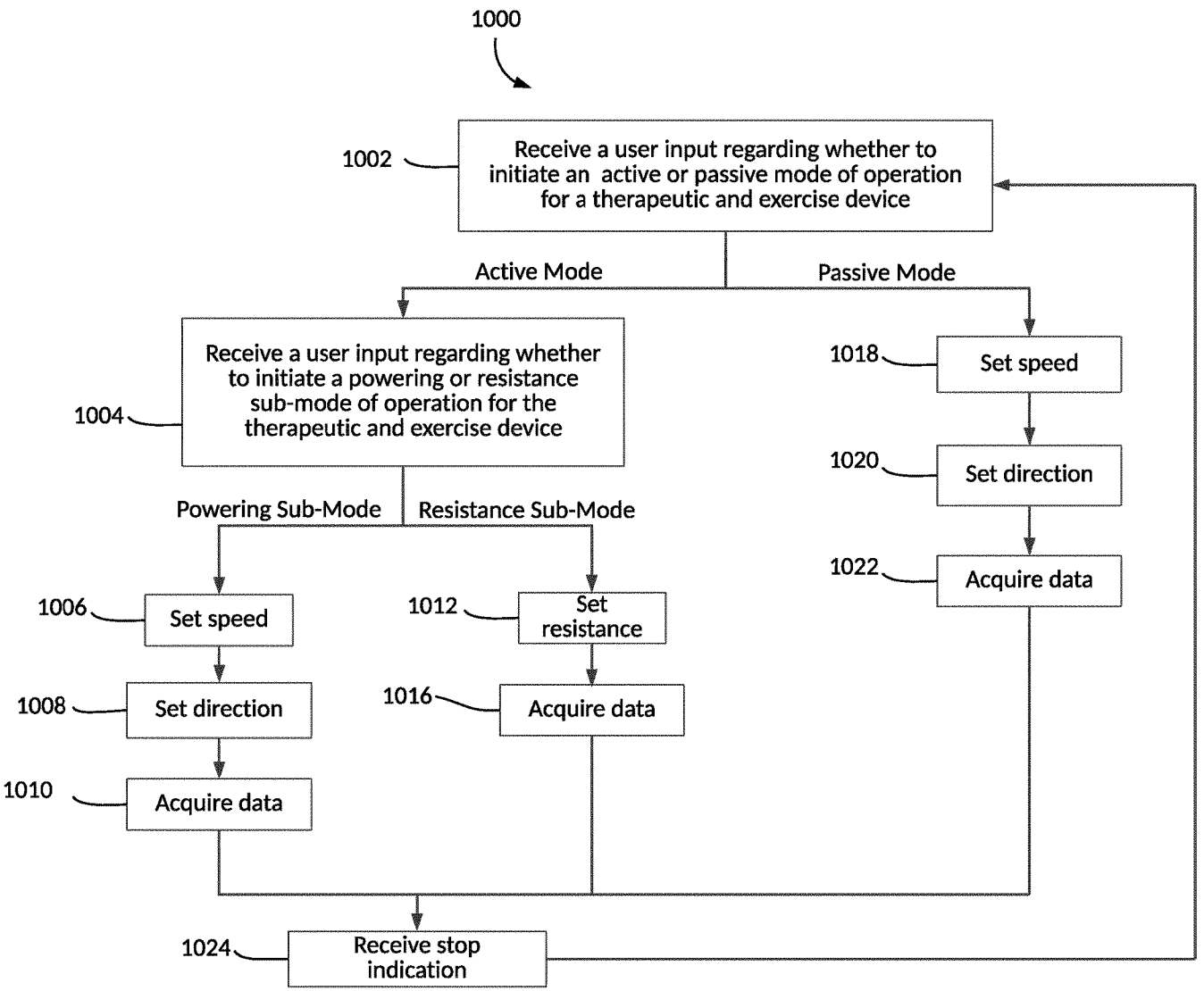
FIG. 10 is a flow diagram of a process for operating the recumbent therapeutic and exercise device of FIGS. 1-8, according to an exemplary embodiment.

With the above and with reference to FIG. 10, operation of the device 100 may be described as follows in reference to process 1000. For reference purposes, FIG. 8 depicts a forward rotational direction and a reverse rotational direction, which correspond respectively with a clockwise rotational direction and a counterclockwise rotational direction based on the right side view of the device 100 in FIG. 8. As mentioned above, the motor 160 is operable in an active operation mode and in a passive operation mode, whereby each of mode of operation is described more fully below.

At process step 1002, a user input is received regarding whether to initiate an active or passive mode of operation for the device 100. User input may be received via display device 125. Referring first to selection of the active mode of operation, the active mode of operation includes a powering sub-mode and a resistance sub-mode. At process step 1004, a user input is received regarding whether to initiate the powering or resistance sub-mode of operation for the device 100. In the powering sub-mode, the motor 160 drives, forces, or otherwise powers (e.g., provides a drive force to) the hand cranks and foot cranks at a sufficient speed to force the user to keep up. In the resistance mode, the motor 160 applies a braking or a resistive force to the hand cranks and foot cranks, which forces the user to overcome this braking or resistive force in order to turn the hand cranks and foot cranks.

Turning to the powering sub-mode of the active operation mode, at process step 1006 the user may provide a desired speed and at process step 1008 the user may provide a desired rotational direction of the foot pedals and hand cranks. For example, the user may utilize the display device 125 or the control panel 127 to designate that the user wants to use to engage in a workout with the hand cranks and foot cranks rotating in the forward direction and at a predefined speed (e.g., 3 miles-per-hour, 50 revolutions-per-minute, or any other nomenclature designation that is used to designate rotational speed, which may also include a scale (1-10) that can be used to represent increasing/maintaining/decreasing the rotational speed of the hand and/or foot cranks). The display device 125 may indicate that the workout will be in X seconds and for the user to engage with the hand cranks and foot pedals. Upon the completion of the X seconds, the motor 160 begins driving or rotating the hand cranks and foot cranks in the forward direction at the designated speed. At which point, the user moves their arms and legs to keep up with the rotating hand cranks and foot cranks. Beneficially, this movement may provide a cardiovascular exercise. At some point, if the user desires to engage in a reverse rotational direction, the user may remove their feet from the foot pedals and their hands from the hand grips and provide a command (e.g., via the display device 125 or control panel 127) to indicate that the user wants the motor 160 drive the hand cranks and the foot pedals in the reverse direction. In combination the user also designates a desired speed. At which point and similar to above, the motor 160 begins driving, powering, or otherwise rotating the hand cranks and foot pedals in the reverse direction. In some instances, the device 100 may be programmed with a variety of exercise, therapeutic, and workout programs, which direct or command the motor 160 to operate at different speeds and different directions for certain periods of time. In either configuration (a programmed workout or a manual operating mode for prescribing the direction and speed), the user may receive a cardiovascular benefit while still being friendly/easy on joints/limbs of a user. At process step 1010, data may be acquired using sensors (actual or virtual—i.e., a not physical sensor where data, values, or information are determined based on various inputs from actual sensors and/or various estimates, guestimates, predictions, etc.) coupled to the foot crank system 130, hand crank system 140, and/or by motor controller 208. Data may include patient data, such as heart rate, or data regarding the foot crank system 130 and hand crank system 140, such as number of rotations. At process step 1024, the user may utilize the display device 125 or the control panel 127 to stop the current workout program. Additionally, the workout program may have a set time period, and upon complete of the time period the workout program will stop.

As an alternative to the "keeping up" aspect of the powering sub-mode, another operation sub-mode of the active mode of operation of the motor 160 is to designate a force (e.g., torque, resistance, braking force, etc.) that the motor 160 applies to the foot crank and hand cranks as well as a desired not-to-exceed rotational speed (i.e., a threshold speed) and a rotational direction. The not-to-exceed rotational speed represents the rotational speed of the foot cranks and the hand cranks that the user attempts to keep the foot cranks and hand cranks at or under. In this regard and during this operating mode, the user resists/is actively fighting against the designated force and speed in order to keep the rotational speed of the foot cranks and hand cranks at a rotational speed that is less than or equal to (i.e., slower) the not-to-exceed rotational speed. Thus, the user is actively working to keep the rotation of the hand cranks and foot cranks slower than a designated speed whereas, in comparison to the resistance sub-mode described below, the user there is fighting against the resistance to keep the hand cranks and foot cranks moving. This motor 160 mode of operation may be beneficial to users looking to strength train various muscle stabilizers of their upper and lower body, as well as gain an aerobic benefit.

At process step 1002, the user may indicate that the resistance sub-mode is desired. Turning to the resistance sub-mode of the active operation mode, at process step 1012 the user may provide a desired resistance level. The motor controller 208 may convert the desired resistance level (e.g., 1, 2, 3, 4, . . . etc.), to a torque output of the motor 160. Thus, to turn or rotate the foot pedals or hand cranks, the user must overcome the torque output (i.e., resistive force) of the motor 160 to enable rotation of the hand cranks and foot pedals. The user may freely switch between a forward rotational direction and a reverse rotational direction during the resistance mode as the output shaft of the motor 160 may remain substantially stationary. That said, the user will have to overcome the torque output in either the forward rotational direction or the reverse rotational direction in order to enable the rotation of the foot cranks and hand cranks. The described configuration above relates to a holding torque implementation where the motor output shaft is stationary. However, in other and more typical arrangements, the motor 160 may still power, rotate, or drive the hand cranks and foot cranks despite a torque being applied to the hand cranks and foot cranks. For example, at a certain torque output, the motor 160 may output a certain output shaft speed. The user will operate the hand cranks and foot cranks in the same direction as that of the motor 160, but will have to exceed the torque output if the user desires a faster rotational speed at the torque output. In either situation, the resistance mode of operation may be used to replicate the user traversing hills on the bike portion of the device 100 or to simulate other more difficult environmental encounters (e.g., a rough terrain). The resistance mode of operation may be desirable for users wanting to strength train in addition to performing a cardiovascular exercise. In this regard, muscle contraction and expansion may be relatively greater during the resistance sub-mode than during the powering sub-mode. At process step 1016, data may be acquired using sensors (virtual or physical/actual) coupled to the foot crank system 130, hand crank system 140, and/or by motor controller 208. Data may include patient data, such as heart rate, or data regarding the foot crank system 130 and hand crank system 140, such as number of rotations. At process step 1024, the user may utilize the display device 125 or the control panel 127 to stop the current workout program. Additionally, the workout program may have a set time period, and upon complete of the time period the workout program will stop.

At process step 1002, the user may select the passive mode of operation. In this mode, the motor 160 is operable to drive or power the hand cranks and foot cranks at a desired speed and in a desired direction. At process step 1018 the user may provide a desired speed and at process step 1020 the user may provide a desired direction of rotation. While this high level description seems similar to the active mode of operation, the passive mode of operation is intended for therapeutic uses. In this regard, rather than the user "actively" working to keep up with rotating foot cranks and hand cranks in the powering sub-mode of the active mode or working to overcome the resistance in the resistance mode of the active mode, here, the user is "passively" receiving a therapeutic benefit from, primarily, operation of the device 100 and motor 160. In other words, the user is passive in that the device 100 is causing movement of the user (i.e., driving the user's arm in a circular motion or driving the user's legs in a circular motion). Hence, the passive mode of operation may also be referred to as the therapeutic mode of operation herein. As an example, the user may desire to stretch out their shoulder to, e.g., increase their mobility because the user has a difficult time doing arm circles. As such, the user may, via the display device 125 or the control panel 127, indicate that they desire a therapeutic operating mode (i.e., the passive mode) and either designate a speed and direction of the foot and hand cranks or (if provided) utilize a predefined speed and direction of the foot and hand cranks. For example, the device 100 may be preprogrammed with a (or multiple) therapeutic workouts/routines that automatically or nearly automatically run once the passive mode of operation is selected, eliminating the need for process steps 1018 and 1020. Then, the user may grip the hand grips 141 that are then rotated at the therapeutic speed, which is typically much slower than in the powering sub-mode. As a result, the motor 160 indirectly causes the user's shoulder's to be moved while the user simply holds onto the grips 141. A similar situation is true with the foot cranks. The user may place their feet in the foot pedals 131, which are driven at a therapeutic pace (typically much slower than in the active mode) to stretch out their legs (e.g., joints and limbs, such as the knee). The user may perform a simultaneous therapeutic exercise by gripping the hand grips 141 and placing their feet in/on the foot pedals 131. At process step 1022, data may be acquired using sensors coupled to the foot crank system 130, hand crank system 140, and/or by motor controller 208. Data may include patient data, such as heart rate, or data regarding the foot crank system 130 and hand crank system 140, such as number of rotations. At process step 1024, the user may utilize the display device 125 or the control panel 127 to stop the current therapeutic program. Additionally, the therapeutic program may have a set time period, and upon complete of the time period the therapeutic program will stop.

Thus, the motorized recumbent and therapeutic and exercise device 100 of the present disclosure is capable of providing exercise and therapeutic benefits to the user. In addition to the aforementioned described active and passive modes of operation, the device 100 may also be operable in a non-motorized mode of operation. In this case, the holding torque of the motor 160 is disabled/de-energized. As a result, the output shaft of the motor 160 freely rotates. As a result, the user may move, turn, or otherwise operate the hand cranks and foot cranks in the forward or reverse directions as if no motor were present on the device 100. Thus, the user only has to overcome the frictional forces due to the transmission 170 and other components in the device 100 in order to cause the rotation of the foot cranks and hand cranks.

Due to these enhanced operational attributes of the device 100, users of all skill levels, capabilities, and fitness levels may find the device 100 of the present disclosure appealing. For example, users who wish to rehabilitate an injury can utilize the therapeutic mode of operation. Users who wish to build strength may utilize the resistance sub-mode of the active mode of operation. Users who desire a cardiovascular exercise may utilize the powering sub-mode of the active mode of operation. And, users who simply want to use the device 100 without motor 160 input may utilize the non-motorized mode of operation.

While control of the motor 160 is described herein with respect to each of the hand cranks and foot cranks, it should be understood that in certain embodiments that the motor may be useable with only one of the foot cranks and the hand cranks. For example, the hand cranks may be unconnected or uncoupled to the motor, such that the aforementioned described modes of operation are only useable with the foot cranks. In another example and vice versa, the foot cranks may be unconnected or uncoupled to the motor, such that the aforementioned described modes of operation are only applicable with the hand cranks. Further, while the device 100 is described herein as only including one motor 160, which is operable with each of the foot cranks and the hand cranks, in other configurations, a first dedicated motor may be provided as part of the hand crank system 140 while a second dedicated motor is provided as part of the foot crank system 130. Thus, the user may individually control operation of each motor to, in turn, control operation of the hand cranks and foot cranks separately. Accordingly, those of ordinary skill in the art will appreciate that aforementioned disclosure describes only one non-limiting embodiment and that other configurations and modifications within the spirit of the present disclosure are intended to fall within the scope of the present disclosure.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and are considered to be within the scope of the disclosure.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

For the purpose of this disclosure, the term "coupled" means the joining of two members directly or indirectly to one another. Such joining may be stationary or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It should be noted that the orientation of various elements may differ according to other exemplary embodiments and that such variations are intended to be encompassed by the present disclosure.

It is important to note that the constructions and arrangements of the recumbent therapeutic and exercise device as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A device for therapy or exercise, the device comprising:

a frame;

a base at least partially supporting and extending from the frame;

a user support moveably coupled to the base and positioned adjacent the frame;

a foot crank system coupled to the frame and comprising a foot crank;

a hand crank system coupled to the frame and comprising a hand crank; and a motor coupled to at least one of the foot crank system and the hand crank system, the motor operable in a plurality of user selectable operating modes including an active mode of operation and a passive mode of operation, wherein the motor selectively powers the at least one of the foot crank system and the hand crank system in the active mode of operation and the passive mode of operation, wherein in response to receiving a selection of the active mode of operation, the motor provides a driving force to at least one of the foot crank system and the hand crank system to rotate at least one of the foot crank and the hand crank at a user selected not-to-exceed rotational speed such that, in use, a user input force resists rotation of the at least one of the foot crank and the hand crank so that a rotational speed of the least one of the foot crank and the hand crank is maintained at or below the user selected not-to-exceed rotational speed.

2. The device of claim 1, further comprising a display device coupled to the frame, the display device configured to allow a user to select the active mode of operation or the passive mode of operation of the plurality of user selectable operating modes and to display performance data relating to the selected active or passive mode of operation.

3. The device of claim 1, further comprising a transmission coupled to the frame and configured to selectively couple the foot crank system and the hand crank system to the motor.

4. The device of claim 1, wherein the foot crank includes a pair of foot pedals coupled to a pair of pedal arms, a pedal shaft coupled to each of the pair of pedal arms, and a pedal pulley coupled to the pedal shaft, wherein rotation of the pedal pulley causes rotation of the pedal shaft and rotation of the pedal arms and the pedals.

5. The device of claim 1, wherein the hand crank includes a pair of hand grips coupled to a pair of crank arms, a crank shaft coupled to each of the pair of crank arms, and a crank pulley coupled to the crank shaft, wherein rotation of the crank pulley causes rotation of the crank shaft and rotation of the crank arms and the hand grips.

6. The device of claim 1, wherein the active mode of operation includes a powering sub-mode and a resistance sub-mode.

7. The device of claim 6, wherein operation of the motor in the powering-sub mode includes providing a driving force via the motor to at least one of the foot crank system and the hand crank system to cause a rotation of at least one of the foot crank and the hand crank at a predefined speed.

8. The device of claim 7, wherein the motor provides a driving force to both the foot crank system and the hand crank system to cause a rotation of the foot crank and the hand crank.

9. The device of claim 6, wherein operation of the motor in the resistance sub-mode includes providing a resistive force via the motor to at least one of the foot crank system and the hand crank system.

10. The device of claim 9, wherein the motor provides a resistive force to both the foot crank system and the hand crank system.

11. The device of claim 1, wherein operation of the motor in the passive mode includes providing a powering force via the motor to at least one of the foot crank system and the hand crank system to cause a rotation of at least one of the foot crank and the hand crank at a predefined speed.

12. The device of claim 11, wherein the motor provides a powering force to both the foot crank system and the hand crank system to cause a rotation of both the foot crank and the hand crank.

13. The device of claim 1, wherein the active mode of operation is configured to provide a specified workout to the user.

14. The device of claim 1, wherein the passive mode of operation is configured to provide a specified therapeutic program to the user.

15. A device for therapy or exercise, comprising:

a frame;

a user support coupled to the frame;

a foot crank system coupled to the frame comprising a foot crank;

a hand crank system coupled to the frame comprising a hand crank; and a motor operable in a plurality of user selectable operating modes including an active mode of operation and a passive mode of operation, the motor configured to selectively power the foot crank system and selectively power the hand crank system in the active mode of operation and the passive mode of operation, wherein the active mode includes a powering sub-mode and a resistance sub-mode, and wherein in the powering sub-mode, the motor provides a driving force to at least one of the foot crank system and the hand crank system to cause a rotation of at least one of the foot crank and the hand crank at a user selected not-to-exceed rotational speed such that, in use, the motor is operable to receive a user input force that resists the rotation of the at least one of the foot crank and the hand crank so that a rotational speed of the least one of the foot crank and the hand crank is maintained at or below the user selected not-to-exceed rotational speed.

16. The device of claim 15, further comprising a display device coupled to the frame that enables a selection of an operation mode of the device.

17. The device of claim 15, wherein operation of the motor in the resistance sub-mode includes the motor providing a resistive force to at least one of the foot crank system and the hand crank system, wherein a level of the resistive force is adjustable via the display device.

18. The device of claim 15, wherein operation of the motor in the passive mode includes the motor providing a powering force to at least one of the foot crank system and the hand crank system to cause a rotation of at least one of the foot crank and the hand crank.

19. The device of claim 15, further comprising a transmission coupled to the frame and configured to selectively couple the foot crank system and the hand crank system to the motor.

20. The device of claim 15, wherein the active mode and the passive mode have predefined settings that direct the motor to operate at set speeds and to cause rotation of the foot crank and hand crank in set directions for a predefined period of time.

21. A method for therapy or exercise, comprising:

providing a therapeutic or exercise device, the therapeutic or exercise device having a frame, a base at least partially supporting the frame, and a user support movably coupled to the base;

providing a foot crank system and a hand crank system coupled to the frame, the foot crank system comprising a foot crank and the hand crank system comprising a hand crank;

providing a motor operable in a plurality of user selectable operating modes, the motor configured to selectively power at least one of the foot crank system and the hand crank system;

operating the motor in a user selected first mode of operation to provide at least one of a driving force and a resistive force to at least one of the foot crank system and the hand crank system via the motor;

in the first mode of operation, providing the driving force to at least one of the foot crank system and the hand crank system to cause a rotation of at least one of the foot crank and the hand crank at a user selected not-to-exceed rotational speed such that, in use, a user input force resists rotation of the at least one of the foot crank and the hand crank so that a rotational speed of the least one of the foot crank and the hand crank is maintained at or below the user selected not-to-exceed rotational speed; and operating the motor in a user selected second mode of operation, wherein the second mode includes providing a powering force to at least one of the foot crank system and the hand crank system via the motor.

* * * * *